US008850815B2

(12) United States Patent
Morrison

(10) Patent No.: US 8,850,815 B2
(45) Date of Patent: Oct. 7, 2014

(54) HYBRID ENGINE

(75) Inventor: Thomas A. Morrison, Delta (CA)

(73) Assignee: 14007 Mining Inc., Richmond, B.C. (CA)

( * ) Notice: Subject to any disclaimer, the term of this patent is extended or adjusted under 35 U.S.C. 154(b) by 1096 days.

(21) Appl. No.: 12/741,012

(22) PCT Filed: Oct. 31, 2008

(86) PCT No.: PCT/CA2008/001922
§ 371 (c)(1),
(2), (4) Date: Jul. 27, 2010

(87) PCT Pub. No.: WO2009/055928
PCT Pub. Date: May 7, 2009

(65) Prior Publication Data

US 2010/0288248 A1 Nov. 18, 2010

Related U.S. Application Data

(60) Provisional application No. 61/001,038, filed on Oct. 31, 2007.

(51) Int. Cl.

| | |
|---|---|
| ***F01K 23/10*** | (2006.01) |
| ***F02G 3/00*** | (2006.01) |
| ***F01K 3/14*** | (2006.01) |
| ***F01K 21/02*** | (2006.01) |
| ***F01K 3/00*** | (2006.01) |
| ***F01K 3/10*** | (2006.01) |

(52) U.S. Cl.
CPC . *F01K 3/004* (2013.01); *F01K 3/14* (2013.01); *F01K 21/02* (2013.01); *F01K 3/10* (2013.01)
USPC ..... 60/618; 60/620

(58) Field of Classification Search
USPC ..... 60/618, 620, 622
See application file for complete search history.

(56) References Cited

U.S. PATENT DOCUMENTS

| | | | |
|---|---|---|---|
| 1,349,619 | A | 8/1920 | Litchfield |
| 2,791,881 | A | 5/1957 | Denker |

(Continued)

FOREIGN PATENT DOCUMENTS

| | | |
|---|---|---|
| FR | 2497541 | 7/1982 |
| GB | 1096884 | 12/1967 |
| JP | 2006-242165 | 9/2006 |

OTHER PUBLICATIONS

International Search Report, dated Jan. 29, 2009, corresponding to PCT/CA2008/001922.

(Continued)

*Primary Examiner* — Thomas Moulis
(74) *Attorney, Agent, or Firm* — Christie, Parker & Hale, LLP

(57) ABSTRACT

A hybrid engine that uses a primary internal combustion engine portion and a secondary external combustion engine portion. In a preferred arrangement, the secondary external combustion engine portion operates as a reciprocating steam engine. The heated exhaust gases of the internal combustion engine portion are used to generate steam, and the steam is used to power the steam engine portion adding the steam engine's power output to that of the internal combustion engine. The thermal efficiency of the hybrid engine may be higher than the thermal efficiency of an internal combustion engine without use of the exhaust gas heat. The hybrid engine uses a configuration in which steam is generated directly in the steam engine and a mechanical link between the internal combustion engine portion and the steam engine portion with the result that the hybrid engine is simple and inexpensive to construct and maintain.

32 Claims, 12 Drawing Sheets

(56) References Cited

U.S. PATENT DOCUMENTS

| | | | | |
|---|---|---|---|---|
| 3,918,263 | A * | 11/1975 | Swingle | 60/614 |
| 3,921,404 | A * | 11/1975 | Mason | 60/618 |
| 4,121,423 | A * | 10/1978 | Querry et al. | 60/616 |
| 4,300,353 | A | 11/1981 | Ridgway | |
| 6,095,100 | A | 8/2000 | Hughes | |
| 6,202,416 | B1 * | 3/2001 | Gray, Jr. | 60/620 |
| 7,017,536 | B2 * | 3/2006 | Scuderi | 123/70 R |
| 7,121,236 | B2 * | 10/2006 | Scuderi et al. | 123/70 R |
| 7,273,023 | B2 * | 9/2007 | Tour et al. | 123/71 R |
| 7,588,001 | B2 * | 9/2009 | Branyon et al. | 123/70 R |
| 7,810,459 | B2 * | 10/2010 | Branyon et al. | 123/70 R |
| 7,954,463 | B2 * | 6/2011 | Branyon et al. | 123/68 |
| 7,975,485 | B2 * | 7/2011 | Zhao et al. | 60/712 |
| 8,006,656 | B2 * | 8/2011 | Branyon et al. | 123/70 R |
| 8,166,759 | B2 * | 5/2012 | Yaguchi et al. | 60/618 |
| 8,267,056 | B2 * | 9/2012 | Dean | 123/68 |
| 2003/0014971 | A1 * | 1/2003 | Scuderi | 60/597 |
| 2006/0124079 | A1 * | 6/2006 | Singh | 123/25 C |
| 2009/0094980 | A1 * | 4/2009 | Sawada et al. | 60/615 |
| 2010/0077987 | A1 * | 4/2010 | Voisin | 123/25 C |

OTHER PUBLICATIONS

Written Opinion of the International Searching Authority, dated Jan. 29, 2009, corresponding to PCT/CA2008/001922.

DE Patent Examination Report dated Apr. 25, 2013 issued in corresponding application No. DE 11 2008 002 967.9 (7 pages).

English language translation of FR 2 497 541, published Jul. 9, 1982, in the name of Moulin, previously listed in an IDS filed Apr. 30, 2010, 8 pages.

* cited by examiner

HYBRID ENGINE

CROSS REFERENCE TO RELATED APPLICATION(S)

This application is a National Phase Patent Application and claims the priority of International Application Number PCT/CA2008/001922, filed on Oct. 31, 2008, which claims the benefit of U.S. Provisional Patent Application No. 61/001,038, filed on Oct. 31, 2007.

FIELD OF THE INVENTION

This invention relates to a hybrid engine that combines together an internal combustion engine and an external combustion engine. The external combustion engine may be a steam engine.

BACKGROUND OF THE INVENTION

A hybrid engine is one in which more than one prime mover contributes power to a single power output. Hybrid engine technology is currently a field of active research and development in the effort to improve the fuel efficiency of heat engines where a heat engine is a device capable of converting heat into mechanical work. An internal combustion engine is a typical heat engine.

The ratio between the energy input to the engine, measured as the calorific value of the fuel multiplied by the rate of fuel flow, and the work output from the engine is called the thermal efficiency. The thermal efficiency of a reciprocating internal combustion engine, such as an automotive engine, may be of the order of 30-40%. Thus 60-70% of the energy contained in the fuel is wasted. This wastage may partly be heat rejected by the engine, which is typically inherent in the functioning of heat engines, partly mechanical friction inside the engine and partly noise emitted by the engine.

Heat rejected may typically appear as:

(a) Heating of the cylinder walls and other engine parts. This heat may be dissipated to atmosphere through air or liquid cooling systems in order to prevent damage to the cylinder(s) and other engine parts.

(b) Hot exhaust gases. Exhaust gas heat may be dissipated to atmosphere through the walls of the exhaust manifold, muffler and exhaust pipe and as a final discharge of warm gases.

Waste heat from internal combustion engines may sometimes be used for heating the interiors of buildings and vehicles but, especially in the case of automotive engines, the proportion of the total heat wastage used for this purpose may typically be very small.

Exhaust gases may typically leave the cylinders of a reciprocating internal combustion engine at temperatures of the order of 1,000° F. Their final exit temperature from the exhaust pipe may be of the order of 100° F.

In a reciprocating steam engine, steam may typically enter the cylinders at temperatures of the order of 500-700° F. and leave the engine at temperatures of the order of 250° F. The temperature range in which a steam engine functions may therefore lie within the range between the initial and final exhaust gas temperatures of a typical internal combustion engine.

A hybrid engine could therefore comprise a primary internal combustion engine with a secondary steam engine using the primary engine's waste heat and adding to the hybrid engine's power output and thermal efficiency. The following references disclose means of generating and using steam from an internal combustion engine exhaust gas.

U.S. Pat. No. 4,300,353 to Ridgway teaches a hybrid engine of the type described above in which the steam is generated in a boiler.

U.S. Pat. No. 4,433,548 to Hallstrom teaches a hybrid internal combustion/steam engine and specifies that steam is generated in a generating chamber by the transfer of heat to water from the hot surfaces of the chamber.

U.S. Pat. No. 4,406,127 to Dunn teaches a hybrid internal combustion/steam engine in which water is sprayed onto the hot surface of an exhaust manifold inside a steam-generating chamber. The resulting steam is used in a closed-circuit reciprocating steam engine.

U.S. Pat. No. 5,000,003 to Wicks discloses a hybrid internal combustion/steam engine in which steam is generated in a boiler and used in a closed-circuit steam engine.

U.S. Pat. No. 5,010,852 to Milisavlevic teaches a multi-fuel, multi-hybrid engine in which part of the power output is provided by steam generated in a boiler.

U.S. Pat. No. 5,191,766 to Vines discloses a hybrid internal combustion/steam engine in which steam is generated in a steam generation chamber which is separated by valving from both the internal combustion cylinder and the means of using the steam. Specifically, the steam is generated in a generation chamber, stored in a compression tank and released to drive a steam turbine operating in closed-circuit with a condenser. The steam generation system is interposed between the internal combustion engine cylinder and the means of using the steam. The transfer of water and steam between the components of the system is handled by valving.

U.S. Pat. No. 6,202,782 to Hatanaka discloses a hybrid engine in which heat is stored and periodically released in a closed-circuit gas turbine system.

U.S. Pat. No. 7,047,722 to Filippone teaches a hybrid internal combustion/steam engine in which the steam is generated and used in a closed-circuit turbine.

In all patents except U.S. Pat. No. 5,191,766, the steam and exhaust gases are separated from each other by heat-transfer walls.

A significant problem with the hybrid internal combustion/steam engines disclosed and under development to date lies in their complexity, bulk, weight and potentially high construction and maintenance costs per unit of power output.

FIG. 1 shows a block diagram of a typical internal combustion/steam hybrid engine 2. The steam engine in this example is a closed-circuit, turbine-type steam engine.

Considering FIG. 1, typically, the quasi-continuous flow of exhaust gases from the internal combustion engine 4 may be used to heat water in a boiler 6. Steam is generated under pressure in the boiler, may be further heated in a superheater 8 and may then be expanded in a turbine-type steam engine 10. The steam may then be passed through a condenser 12. The condensate water may then be pumped back into the boiler 6 by a feed pump 14 powered by the internal combustion engine.

The rotational speed and speed-torque characteristics of the turbine 10 may typically differ from that of the internal combustion engine 4. Consequently, the turbine may drive an electric generator 16 which drives an electric motor 18, the power output of which may then be applied to the hybrid engine drive shaft.

Whether the steam circuit is closed (with a condenser 12 returning exhaust steam to the boiler 6 as water) or open (exhausting steam to atmosphere), the boiler 6 requires an injector or feed pump (not shown) to force water into the boiler against the pressure of the steam being generated there.

The injector or feed pump consumes some of the power produced by the hybrid engine.

While these arrangements may tend to maximize thermal efficiency, they may also tend to make a hybrid internal combustion/steam engine substantially bulkier, heavier and more complicated than a conventional internal combustion engine of equivalent power output and, hence, more costly to construct and maintain, thereby detracting from its total economy.

SUMMARY OF THE INVENTION

Applicant has developed a new hybrid engine design wherein the exhaust gas heat of an internal combustion engine is used to generate gas and the generated gas is used to power an external combustion engine adding its power output to that of the internal combustion engine. The thermal efficiency of the hybrid engine may be higher than the thermal efficiency of an internal combustion engine without use of the exhaust gas heat.

Accordingly, there is disclosed a hybrid engine comprising:

- a primary internal combustion engine portion having at least one primary cylinder housing a primary piston for reciprocating movement to drive a primary crankshaft;
- a secondary external combustion engine portion having at least one secondary cylinder housing a secondary piston for reciprocating movement to drive a secondary crankshaft;
- a gearing system interconnecting the primary and secondary crankshafts;
- an inlet to the at least one primary cylinder controlled by an inlet valve to deliver fuel to the at least one primary cylinder to generate a power stroke for the primary piston;
- an outlet from the at least one primary cylinder controlled by a first outlet valve for discharge of exhaust gases from the at least one primary cylinder on an exhaust stroke of the primary piston, said outlet communicating with the at least one secondary cylinder;
- an outlet from the at least one secondary cylinder controlled by a second outlet valve for exhaust gases to exit the at least one secondary cylinder;
- a fluid reservoir to store heat generated in the at least one primary cylinder; and
- a fluid inlet for delivering fluid from the fluid reservoir to the at least one secondary cylinder for contact with the heated exhaust gases for vapourization into a volume of gas to generate a power stroke for the secondary piston wherein the power strokes of the primary and secondary pistons contribute to rotation of the primary crankshaft.

In another aspect, there is provided a hybrid engine comprising:

- a primary internal combustion engine portion to drive a primary crankshaft;
- a secondary external combustion engine portion to drive a secondary crankshaft;
- a gearing system interconnecting the primary and secondary crankshafts;
- an inlet to deliver fuel to the primary internal combustion engine portion to generate power for driving the primary crankshaft;
- an outlet from the primary internal combustion engine to discharge heated exhaust gases, said outlet communicating with the secondary external combustion engine portion;
- an outlet from the secondary external combustion engine portion for exhaust gases to exit;
- a heat reservoir to store heat generated by the primary internal combustion engine portion; and
- a fluid reservoir for delivering fluid to the secondary external combustion engine portion for contact with the exhaust gases for vapourization into a volume of gas to generate power for driving the secondary crankshaft wherein rotation of the secondary crankshaft contributes to rotation of the primary crankshaft.

Embodiments of the present hybrid engine may use as the external combustion engine portion, a reciprocating, steam engine arrangement.

Embodiments of the present hybrid engine may be simpler and cheaper to construct and maintain than engines of equivalent power output disclosed in the referenced prior patents.

Embodiments of the presenting hybrid may be of lesser weight and bulk per unit of power output than the engines disclosed in the referenced prior patents.

Embodiments of the present hybrid engine include a steam engine that operates within the temperature range between the initial and final exhaust gas temperatures of the internal combustion engine.

Embodiments of the present hybrid engine include a reciprocating, open-circuit steam engine, as distinct from a turbine, closed-circuit steam engine. A reciprocating, open-circuit steam engine may typically be simpler and cheaper to construct than a closed-circuit, turbine steam engine of similar power output.

Embodiments of the present hybrid engine may include a reciprocating steam engine which adds its power output to that of the internal combustion engine by direct mechanical means, such as gearing, which tends to make the present hybrid simpler and cheaper to construct and maintain than the addition of power to the internal combustion engine by indirect means, such as electrical means.

Embodiments of the present hybrid engine generate steam in the cylinder(s) of the reciprocating steam engine. This may make a reciprocating steam engine effective at higher cycling rates than might normally be practical in a conventional reciprocating steam engine, where the steam is generated outside the cylinder, allowed to enter the cylinder and then allowed to expand within the cylinder.

Embodiments of the present hybrid engine make use of steam generated without a boiler. Such an engine without a boiler may be simpler and cheaper to construct than a hybrid engine of similar power output incorporating a boiler.

Embodiments of the present hybrid engine provide an engine in which the power of the steam engine may begin to develop substantially simultaneously with the starting of the internal combustion engine.

Embodiments of the present hybrid engine may provide the above-listed benefits without inducing substantial back pressure in the exhaust of the internal combustion engine.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
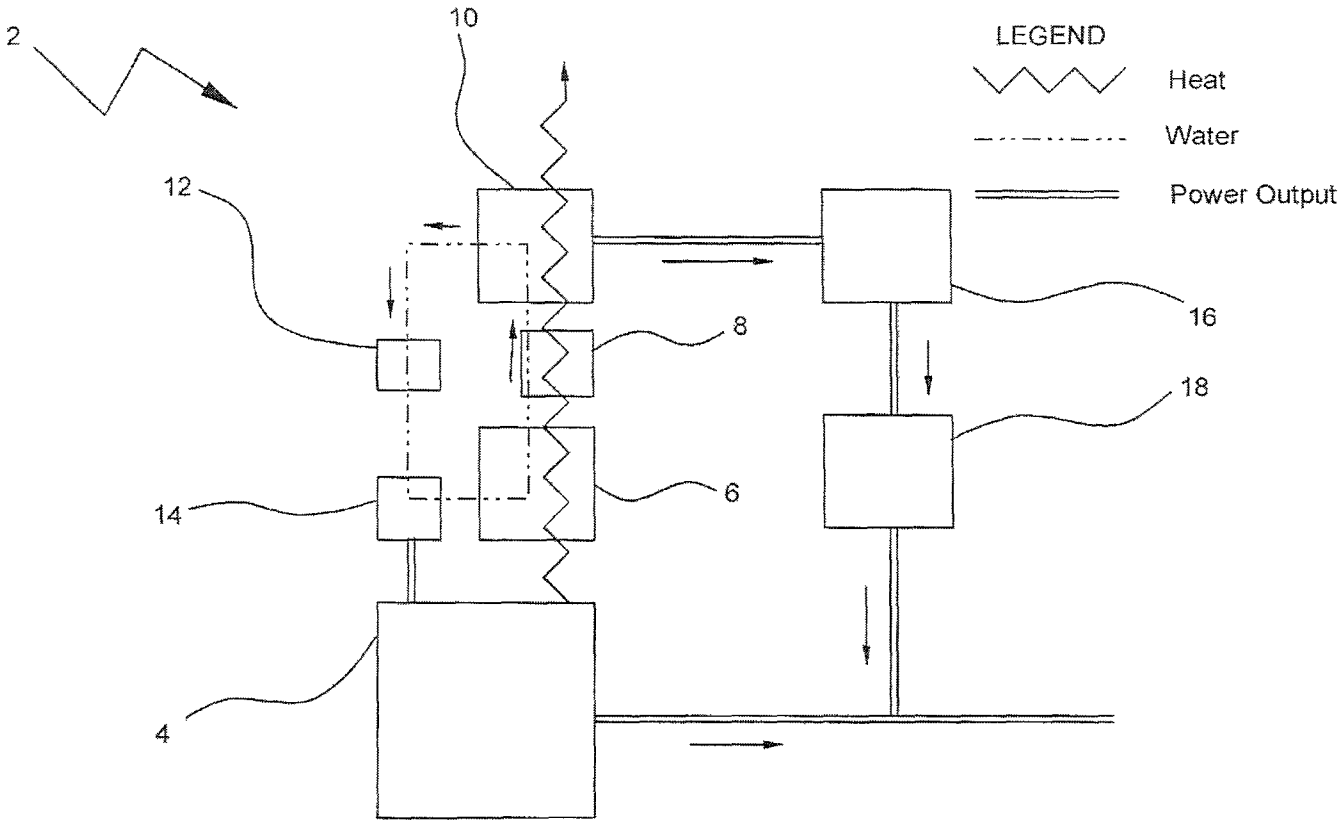
Fig. 1 PRIOR ART
FIG. 1 is a schematic diagram of the components and operation of a prior art internal combustion/steam hybrid engine.

In embodiments discussed below, the hybrid engine embodiments employ a steam engine as the secondary external combustion engine portion, however, it will be understood that other external combustion engine arrangements may be used.

The present hybrid engine was developed according to the following simplifying steps which render the engine generally simpler and, hence, cheaper to construct and maintain than the internal combustion/steam hybrid engines disclosed or under development hitherto:

1. Use of an open-circuit, reciprocating steam engine as the secondary engine.
2. Operation of the steam engine at high cycling rates.
3. Elimination of the boiler.
4. Steam pressure not limited by the structural limitations of a boiler and steam transmission system.
5. Proximity of steam generating means to IC exhaust outlet.
6. Minimization of back pressure.
7. Elimination of an unwanted compression stroke.

Each of the above simplifying steps generates a problem which had to be solved to arrive at the solution of the present hybrid engine.

Step 1: Use of a Reciprocating Steam Engine

A first step in reducing the complexity of an internal combustion/steam hybrid engine may be to use a reciprocating steam engine instead of a turbine steam engine. A reciprocating steam engine may typically be simpler and cheaper to construct and maintain than a turbine steam engine of similar power output.

This brings the problem that reciprocating steam engines, e.g. locomotive engines, tended to be adversely affected by the viscosity of the steam at cycling rates higher than 350-400 revolutions per minute. At and above such cycling rates, the opening time of the valves admitting steam to the cylinders was so short that the admission of steam was limited and the possible power output of the engine at those cycling rates was limited as a consequence.

In internal combustion engines, pressure is generated and applied substantially simultaneously inside the cylinders, permitting higher cycling rates and, hence, higher power density, where power density is measured as the power output per unit of engine bulk or weight.

Conventional internal combustion engines typically function at cycling rates of the order of 2,000-4,000 revolutions per minute. This would bring into question whether any useful power output could be obtained from a conventional reciprocating steam engine at those cycling rates.

Step 2: Operation of the Steam Engine at High Cycling Rates

In the present hybrid engine, a reciprocating steam engine may be used as the secondary engine of the hybrid engine. Steam may be generated inside the cylinder(s) of the steam engine by passing internal combustion exhaust gases through the cylinder and injecting a fine spray of water. This water may be preheated almost to boiling point before being injected into the cylinders.

This may:

(a) Allow the reciprocating steam engine to operate at similar cycling rates to the internal combustion engine;
(b) Allow the power output of the secondary steam engine to be connected to the power output of the primary internal combustion engine by direct means, such as gearing;
(c) Eliminate a separate boiler.

Step 3: Elimination of the Boiler

Generation of steam inside the cylinder may provide a further significant benefit as a third step, namely elimination of the boiler.

With the exception of U.S. Pat. No. 5,191,766, the hybrid engines disclosed in the mentioned references comprise the generation of steam in pressurized systems separated by heat transfer walls from the internal combustion engine exhaust gas, typically and generically known as boilers or heat exchangers.

Several problems tend to arise from such systems:

(a) Construction and maintenance cost.
(b) Chemical reactions between impurities in the water and the materials of the system.
(c) Deposition of solids in the system from the water, whether entrained matter or chemical precipitates, and the consequent need for clean and/or treated water.
(d) Water needs to be clean and "soft" if problems (b) and (c) are to be minimized.
(e) The structure, in particular the walls separating the water/steam space from the hot gas space, must be strong enough to contain the steam pressures generated in the water/steam space. The thicker the walls, the slower the rate of heat transfer from the hot gases to the water. This issue may be significant where the gases necessarily have a limited dwelling time in the system, as is the case with the exhaust gases from an internal combustion engine.
(f) The passage ways by which the heated gases pass through the hot gas space of the boiler may exert a friction on the gases which may consume some form of useless work necessarily done by the engine and detracting from its thermal efficiency.
(g) The rate of steam generation tends to be proportional to the area of heat-transfer wall that is heated by the hot gases and is in contact with the water. This wall area may be increased by passing the hot gases through multiple, curved, coiled, finned or corrugated tubes, channels or conduits, but the need to maximize this area may be a design problem, may add to the useless work done in (f) above, and may add to the weight, bulk and cost of the system.

(h) The rate of steam generation tends to be limited by the rate at which water can be circulated through the water/steam space and converted into steam.

(i) Before steam can be generated, the whole mass of water in the water/steam space must be heated to boiling point. In a hybrid internal combustion/steam engine, some appreciable period may elapse, after the internal combustion engine is started, before steam can be generated and before the steam part of the hybrid engine can have an effect. This problem may be significant in some automotive applications in which engine running times are short.

(j) Heat must typically be applied to one part of the boiler before others. Uneven expansion and contraction of different parts of the boiler tend to result in uneven distribution of stress, causing leakage and maintenance costs.

(k) In a hybrid internal combustion/steam engine, the exhaust gases from the internal combustion engine must be disposed of as they are produced. The dwelling time of the hot gases in the steam generator is therefore limited.

(l) Water must be pumped or injected into the boiler by a means capable of overcoming the pressure of the steam already inside the boiler. This consumes work which is deducted from the power output of the steam engine.

(m) The power output of the steam engine is in direct proportion to the pressure of the steam as it is generated. It is difficult or impractical to increase the pressure of the steam above that produced in the boiler. The boiler must therefore be constructed to withstand the design pressure of the system. The boiler is typically fitted with a safety valve; steam pressures in excess of the safe design limit of the boiler are wasted through the safety valve. In practice the steam may tend to lose pressure in passing from the boiler to the expansion means and therefore the highest steam pressure in the system is likely to be that inside the boiler. The boiler, its fittings and steam pipes tend to be a relatively complex structure not well adapted to resisting internal pressure. All of the fittings and piping must be constructed to withstand the steam pressure inside the boiler.

Elimination of the boiler in a hybrid internal combustion/steam engine would, therefore, be a significant benefit.

Step 4: Steam Pressure in Cylinder Not Limited to Boiler Pressure

The thermal efficiency and power output of a steam engine is in proportion to its steam pressure. The highest attainable steam pressure is therefore desirable, but in a conventional steam-generating system is limited by the factors mentioned in items (a), (e) and (m) above. The problems listed in items (b) to (d) also typically increase with increasing steam pressure and temperature.

Concerning item (m) above, the steam pressure is typically contained in the steam cylinder and in a boiler, its fittings and steam pipes. The cylinder is a better shape than the boiler system for resisting internal pressure. In the present hybrid engine, water is injected as a fine spray into the secondary (steam) cylinder(s) at just below its boiling point, and exposed directly to internal combustion exhaust gases at temperatures of the order of 1,000° F. without an intervening heat transfer wall. The resulting steam pressure would be confined within the steam cylinder(s). The cylinder(s) may be built to withstand these pressures.

Step 5: Proximity of Steam Generation to Internal Combustion Exhaust

In an internal combustion engine, the exhaust gases may typically begin to lose heat as soon as they leave the cylinders. This is partly due to adiabatic cooling and partly due to conduction and convection through the walls of the exhaust system. Thus, the exhaust gases are never as hot as when leaving the cylinders. It would therefore be desirable to locate the steam generating means as close as possible to the exhaust gas outlet from the internal combustion cylinders. The present hybrid engine provides this additional benefit of proximity between steam generation and internal combustion exhaust.

Step 6: Minimization of Back Pressure

If a pressurized boiler, with a water/steam space separated by heat transfer walls from the exhaust gases, can be dispensed with, as in U.S. Pat. No. 5,191,766, the problem arises how the steam can be induced to exert pressure on a power-producing means without also exerting a back pressure into the internal combustion cylinder, considering that:

(a) Each internal combustion cylinder produces exhaust gas intermittently at a discrete point in its functioning cycle;

(b) The dwelling time of the exhaust gas in the secondary engine is necessarily limited, as, without a boiler, the exhaust gas must be exhausted from the secondary engine as quickly as it is produced by the primary engine.

U.S. Pat. No. 5,191,766 discloses the generation of steam directly by a mixing of the internal combustion exhaust gas with a spray of water, followed by expansion of the steam in a turbine. The '766 patent does not disclose a means by which the steam can be generated and expanded inside a reciprocating engine cycling at high rates and driving directly on the hybrid engine drive shaft.

U.S. Pat. No. 5,191,766 depends for its functioning on a one-way flow of fluids and gases from the internal combustion exhaust outlet through the steam-generating system. The '766 patent specifies at least one "one-way valve." Unless a pump is interposed, which would consume energy and add to the cost and complexity of the system, this flow can take place only if the pressure in the internal combustion exhaust outlet is higher than the pressure in the system for generating and applying steam pressure. In other words, the back pressure in the internal combustion exhaust outlet must exceed the pressure in the steam system. This may be undesirable as a portion of the mechanical work done by the internal combustion engine must necessarily be used to overcome this back pressure.

The present hybrid engine discloses a means by which the back pressure in the internal combustion exhaust outlet may be no greater than the friction head between the internal combustion exhaust and the final exhaust.

Step 7: Elimination of an Unwanted Compression Stroke

The reciprocating steam engine portion of the present hybrid engine would typically require a piston stroke in the steam cylinder to receive exhaust gases from the internal combustion cylinder, whereby the piston in the steam cylinder would move in the direction from top dead center (TDC) towards bottom dead center (BDC).

(Top dead center is a term typically used to describe the piston position where the contained volume inside the cylinder is at a minimum. Bottom dead center is a term typically used to describe the piston position where the contained volume inside the cylinder is at a maximum. Both of these terms are used regardless of the physical attitude or orientation of the cylinder.)

This intake stroke needs to be followed by a piston stroke powered by the steam generated by the internal combustion exhaust gases within the steam cylinder, also moving in the direction from TDC towards BDC.

There would then need to follow an exhaust stroke, whereby the steam piston would tend to move in the direction from BDC towards TDC. This piston stroke would exhaust a mixture of steam and exhaust gases from the steam cylinder in preparation to receive another charge of internal combustion exhaust gases.

The desired cycle would thus consist of two piston strokes in the direction from TDC towards BDC, but only one in the direction from BDC towards TDC. A stroke in the direction from BDC towards TDC, interposed between the two strokes from TDC towards BDC would tend either to exhaust the fluids and gases if they were not confined within the steam cylinder, or to compress them if they were confined within the steam cylinder. Exhausting them from the cylinder would minimize the work that they could do. Compressing them would consume work for no desirable purpose and would therefore detract from the power and efficiency of the steam engine. The present hybrid engine provides a solution to this problem.

Figure 2B:
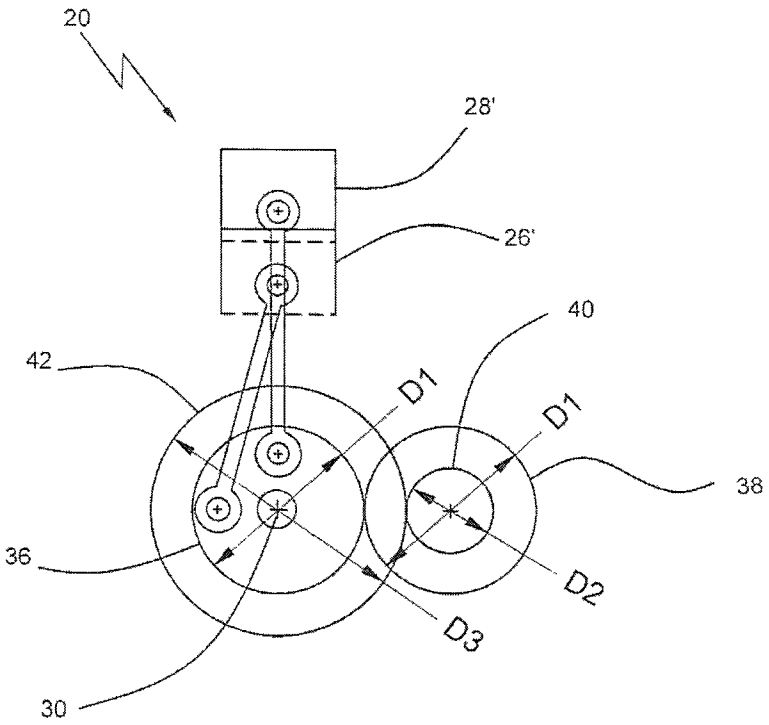
FIGS. 2A and 2B show a top and an end elevation view, respectively, of a hybrid engine according to a first embodiment.
Figure 2A:
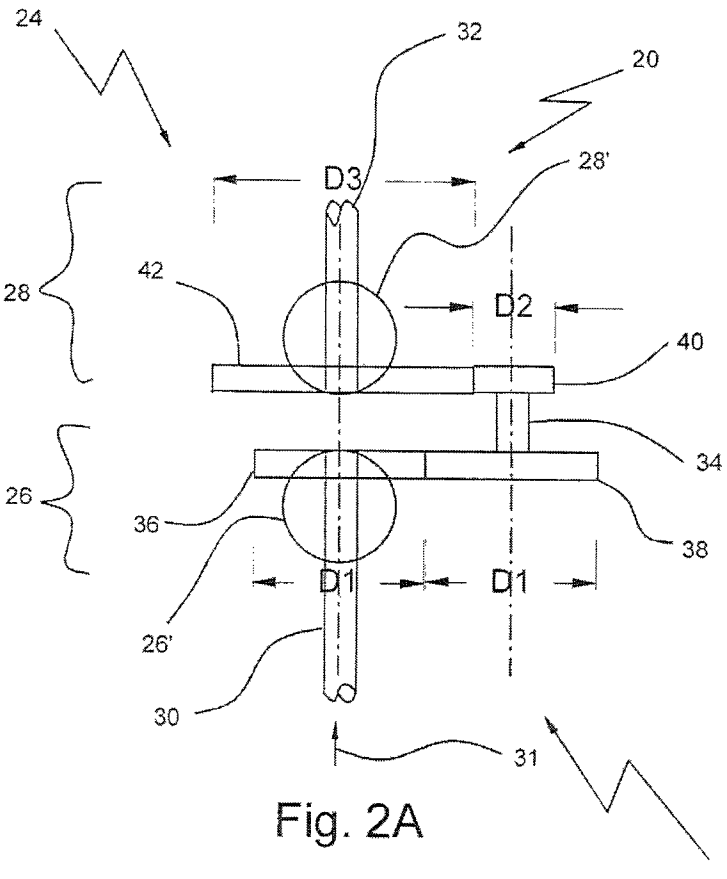
Figure 3:
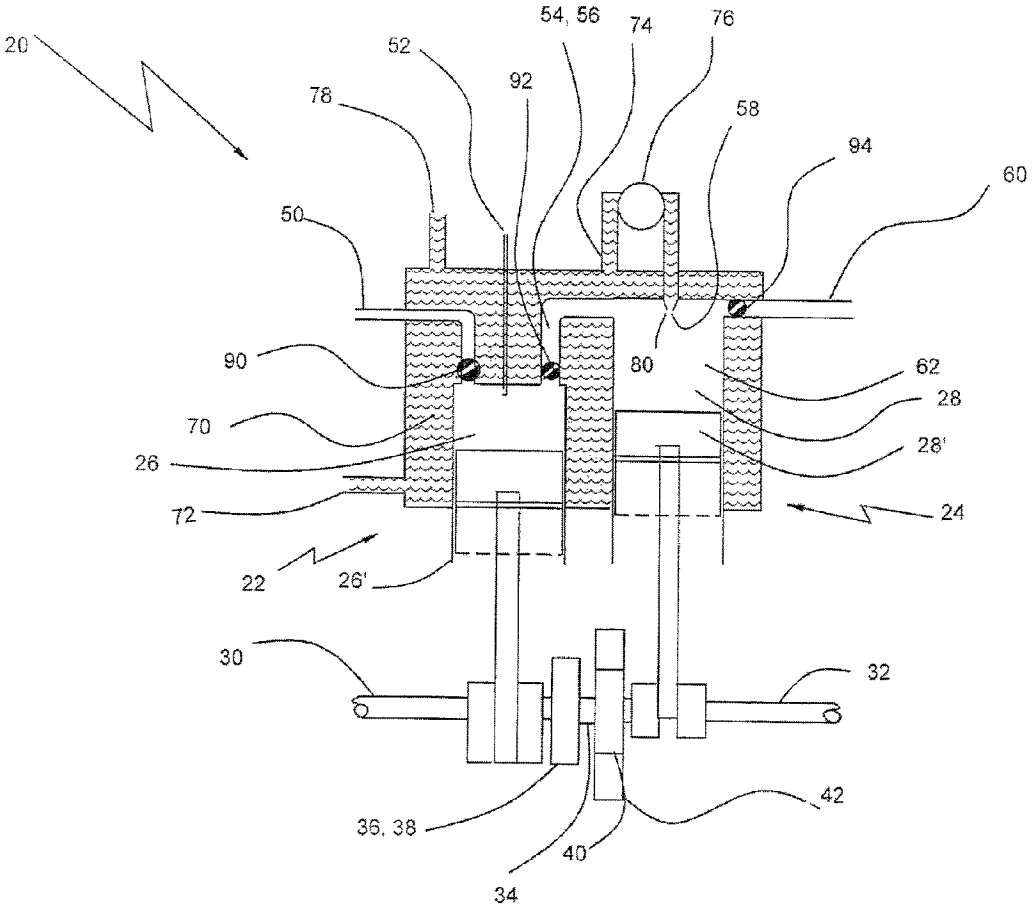
FIG. 3 is schematic view side elevation view showing further details of the first embodiment.

Referring to FIGS. 2A, 2B and 3, there is shown schematically a first embodiment of a hybrid engine 20 according to the present invention designed according to the simplifying steps outlined above and incorporating the solutions to the various problems discussed.

Figure 4:
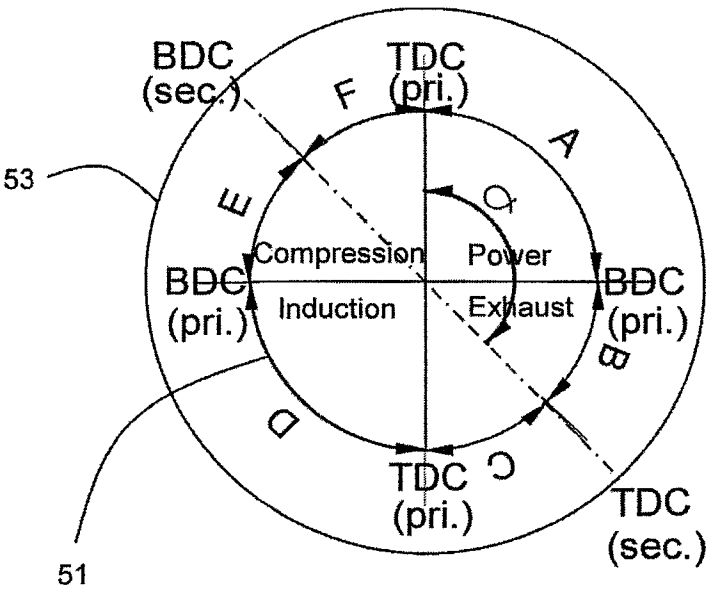
FIG. 4 is a cycle diagram showing the operation of the hybrid engine according to various embodiments.

This hybrid engine 20 may consist of a primary internal combustion (IC) engine portion 22 and a secondary external combustion engine portion 24 functioning in accordance with a duplex cycle as shown in FIG. 4. In a preferred arrangement, the primary internal combustion engine portion 22 is a reciprocating internal combustion engine and the secondary external combustion engine portion 24 is an open-circuit, reciprocating steam engine.

FIGS. 2A and 2B show a top plan view and an end elevation view, respectively, of a first embodiment of the hybrid engine. FIG. 2B is taken along the line of sight indicated by arrow 31. The hybrid engine 20 comprises at least one primary cylinder 26 and primary piston 26' arrangement (the "primary internal combustion engine") and at least one secondary cylinder 28 and secondary piston 28' arrangement (the "secondary external combustion engine").

Considering FIG. 2A, the primary internal combustion engine 22 may typically drive the primary crankshaft 30, which is the power output from the hybrid engine. The crankshaft 32 of the secondary external combustion engine is geared to the primary crankshaft 30 by an idler shaft 34. The secondary engine may, therefore, either add power to the primary crankshaft, or may draw power from the primary crankshaft.

FIG. 2B shows there may be a phase difference between the primary piston 26' and primary crankshaft 30 and secondary piston 28' and crankshaft 32.

FIGS. 2A and 2B show that the secondary crankshaft 32 is geared to the primary crankshaft 30 in such a manner that the secondary crankshaft may typically turn at some fraction of the rate of the primary crankshaft. In the illustrated embodiment, gear 36 is fixed to the primary crankshaft 30 and drives gear 38; gears 36 and 38 are of the same diameter (D1) and therefore turn at the same speed. Gears 38 and 40 are fixed to the idler shaft 34 such that gear 38 drives gear 40 through the idler shaft 34. Gear 42 is fixed to the secondary crankshaft 32 such that gear 40 drives gear 42. Gears 38 and 40 will rotate at the same rate because they are connected through the idler shaft 34. Gear 40 is of smaller diameter (D2) than gear 38 and gear 42 is of larger diameter (D3) than gear 40. Gear 42 will therefore turn at some fraction of the rate of gear 26, depending on the relative diameters D1, D2 and D3. The skilled person will appreciate that other gear arrangements are possible.

Turning to FIG. 3, there is shown a schematic side view of the hybrid engine of the first embodiment showing further details. The primary cylinder 26 may be a conventional cylinder fitted with a valved fuel/air inlet 50, a spark plug 52 (unless the internal combustion engine is a diesel-type engine) and a valved exhaust gas outlet 54. The exhaust gas outlet 54 may be connected to the secondary (steam) cylinder 28, either one-to-one or through a manifold. The primary cylinder 26 may function on the four-stroke cycle.

Each secondary steam cylinder 28 may be fitted with a valved inlet 56 for the exhaust gases from the primary internal combustion cylinder, corresponding to the valved exhaust gas outlet 54 from the primary cylinder, a water nozzle 58 and a valved exhaust outlet 60. Each secondary steam cylinder 28 may contain an enlarged headspace 62, such that the volume inside the secondary cylinder 28, when the secondary piston is at top dead center (TDC) may be approximately equal to the volume swept by the primary internal combustion piston 26' in the primary cylinder 26.

The secondary piston 28' may be geared to the primary piston 26' so that the secondary piston cycles at some fraction of the rate of the primary piston. This may be achieved by the gearing arrangement shown in FIGS. 2A and 2B and described previously. The secondary piston 28' may therefore be capable of being driven by the primary crankshaft 30 during one part of the cycle and driving the primary crankshaft 30 during another part of the cycle.

The flow of gases and fluids through the primary cylinder 26 and secondary cylinder 28 may be controlled by valves 90, 92 and 94 which will be described in more detail below. The valves are typically three in number per pair of cylinders and are adapted to open and close in conformity with the functioning of the engine as described below and as shown in FIGS. 5 to 10.

In the illustrated first embodiment, the secondary cylinder 28 may exhaust to atmosphere. In an alternative embodiment, the secondary cylinder 28 may exhaust to a second-stage engine or some other heat recovery means. In a further embodiment, each primary cylinder 26 may exhaust to more than one secondary cylinder 28 in sequence. Embodiments incorporating these additional configurations will be discussed below in association with FIGS. 11 to 14.

Returning to the illustrated first embodiment of FIG. 3, the hybrid engine 20 may typically be provided with a supply of fluid for cooling and/or steam generation. It will be understood that the fluid will typically be water, but may also be water mixed with other substances or some fluid, mixture of fluids, emulsion or solution other than water. In the illustrated embodiment of FIG. 3, the supply of fluid is a fluid reservoir in the form of a water jacket 70 which surround the primary cylinder 26 or both cylinders 26, 28. The purpose of the water jacket is both to cool the cylinder(s) and to heat the water. The water may be heated to just below its boiling point, but the temperature should be controlled so that the water does not boil in the jacket.

The water jacket 70 may be provided with two outlets. A pump or other means (not shown) may draw water from a first outlet 72 of the water jacket and circulate the water through a radiator (not shown) so as to control the temperature of the water in the water jacket.

A pump 76 or other means may draw water from the water jacket through a second outlet 74 and force the water through the water nozzle 58 into the secondary cylinder 28 as a spray 80 of atomized water particles. The flow rate of water and the fineness of the spray may be adjustable.

Atmospheric or other external pressure may tend to replenish the water in the water jacket from an external supply via inlet 78. Inlet 78 also serves as the return inlet for water circulated through the radiator.

The atomized water spray 80 injected into the secondary cylinder 28 may tend to expose a very large surface area of water per unit volume of water to the hot exhaust gases, being the total surface area of a very large number of fine droplets. The volume of each droplet may typically be very small, so that a rapid conversion of water to steam may take place. The water, already heated to just below its boiling point during its passage through the water jacket 70, may therefore be sprayed into the steam cylinder and converted into steam by direct contact with the exhaust gases from the internal combustion engine, which may be at temperatures of the order of 1,000° F.

The rate of water flow from water nozzle 58 may be adjustable so that the maximum amount of steam may be generated.

The primary piston 26' and secondary piston 28' typically drive crankshafts 30 and 32, respectively, as described above with reference to FIGS. 2A and 2B.

Also as described above, the crankshafts 30 and 32 may be connected so that the secondary piston 28' cycles at some fraction of the rate of the primary piston 26' and at some phase angle to the primary piston. In this first embodiment, the secondary piston may typically cycle at half the rate of the primary piston at a phase angle of 135 degrees between TDC in the primary piston and TDC in the secondary piston. It will be appreciated by a skilled person that phase angles other than 45 and 135 degrees may be possible or even preferable.

Also as described above, the primary and secondary crankshafts may be connected in a manner such that the secondary piston 28' may drive the primary crankshaft 30 during one part of the cycle and may be driven by the primary crankshaft during some other part of the cycle.

In alternative embodiments to those already described, there may be more than one secondary cylinder 28 for each primary cylinder 26. The secondary pistons 28' may cycle at some rate other than half the rate of the primary pistons. The secondary pistons 28' may cycle at some phase angle(s), other than 45 degrees and 135 degrees to the primary pistons 26'. The motion of either or both pistons may be other than sinusoidal.

Figure 5:
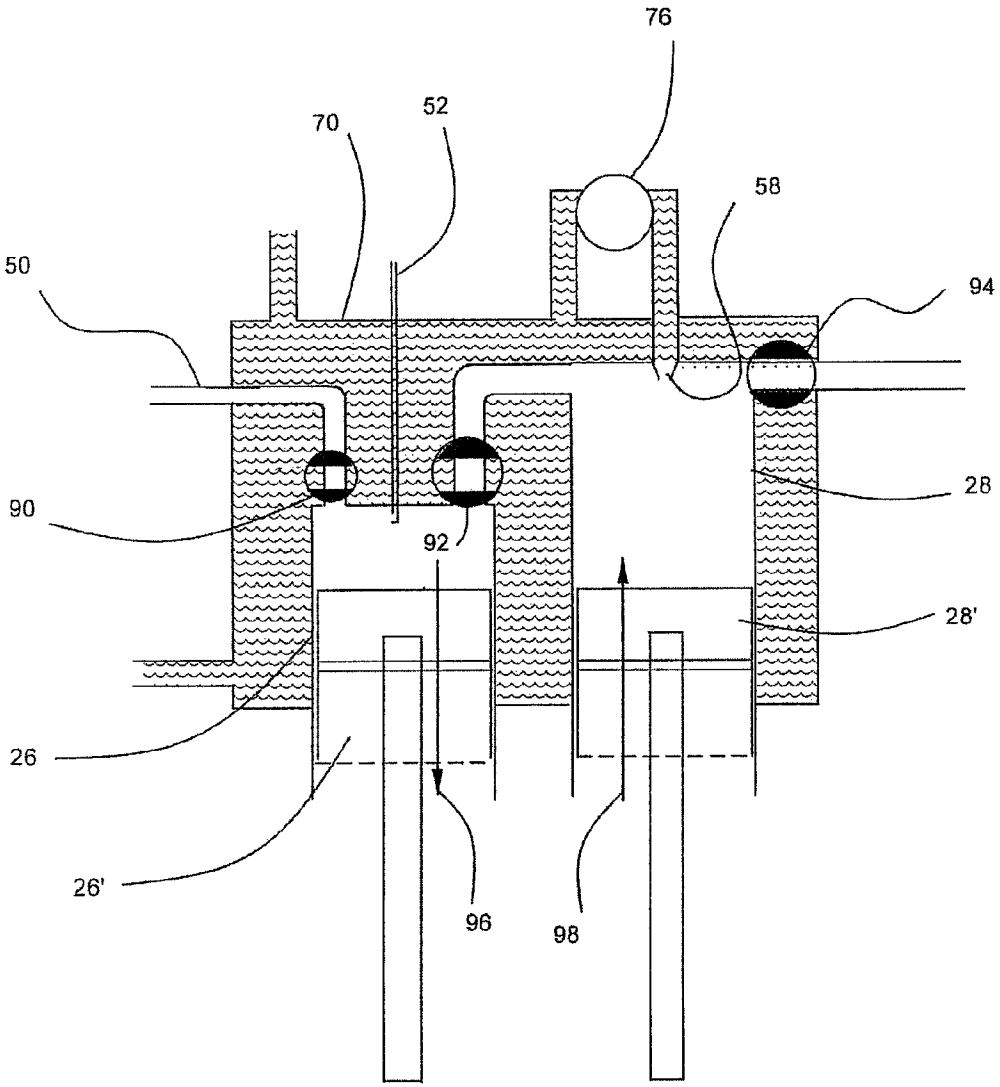
FIGS. 5 to 10 show schematically the movement and co-operation of elements of embodiments of the hybrid engine over a full operating cycle.

Referring to FIG. 4, there is shown a diagram of the rotary cycle of the primary and secondary pistons with the cycle of a primary piston being shown in the inner circle 51 and the cycle of a secondary piston being shown in the outer circle 53. The difference in phase angle between the primary and secondary pistons as measured between the TDC position of each piston is shown as angle $\alpha$. Angle $\alpha$ in the illustrated example is 135 degrees. FIG. 4 shows the primary and secondary pistons functioning on a duplex cycle comprising six phases labeled A to F, which are shown in FIGS. 5 to 10. The conventional four stroke cycle of the primary piston including the power, exhaust, induction and compression stages is indicated in FIG. 4. Details of each phase of the cycle are as follows making reference to FIG. 4 and the indicated Figures:

Phase A: FIG. 5

Phase A begins with the primary piston 26' at top dead centre (TDC (pri)) and the secondary piston 28' approximately one quarter the way from bottom dead centre (BDC (sec) to TDC(sec). The primary cylinder inlet valve 90 and exhaust valve 92 are both closed. The secondary exhaust valve 94 is open.

During Phase A, the primary piston 26' makes its power stroke from TDC(pri) to BDC(pri) as indicated by arrow 96 in FIG. 5, driven by the combustion of the fuel/air mixture in primary cylinder 26 after ignition by spark plug 52. The secondary piston 28' moves toward TDC(sec) as indicated by arrow 98 in FIG. 5, making a portion of its exhaust stroke, exhausting a used mixture of steam and exhaust gases through the open secondary exhaust valve 94.

At the end of Phase A, the primary piston 26' reaches BDC(pri), and the secondary piston 28' may be approximately three quarters of the way from BDC(sec) toward TDC (sec). The primary exhaust valve 92 opens and the secondary exhaust valve 94 remains open. The primary inlet valve 90 remains closed.

Figure 6:
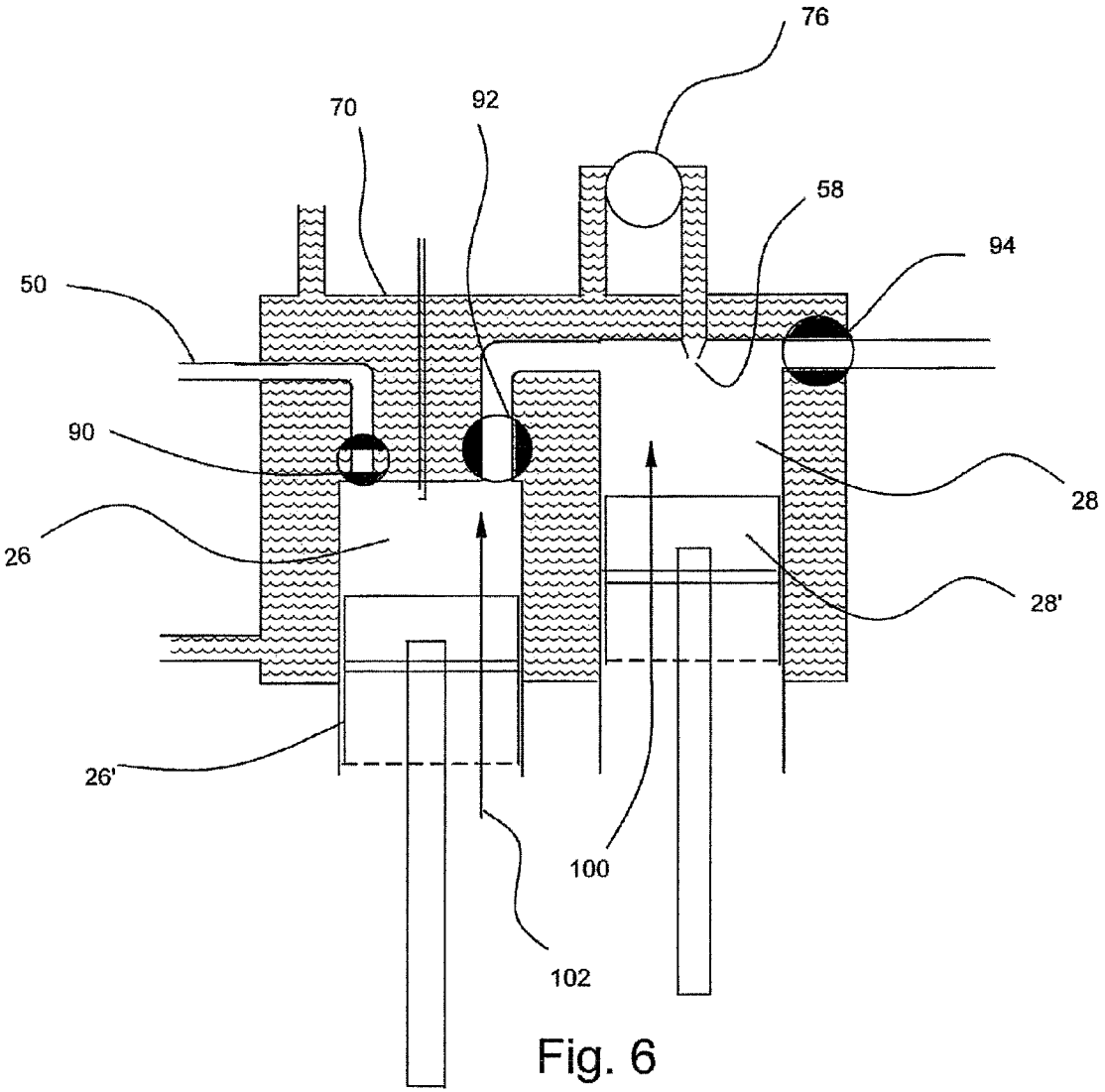

Phase B: FIG. 6

Phase B begins with the primary piston 26' at BDC(pri). The secondary piston 28' may typically be approximately three quarters of the way from BDC(sec) to TDC(sec) moving in the direction of arrow 100 in FIG. 6. The primary inlet valve 90 is closed; the primary exhaust valve 92 opens; the secondary exhaust valve 94 remains open.

During Phase B, the primary piston 26' begins its exhaust stroke in the direction of arrow 102 in FIG. 6. The secondary piston 28' may typically complete its exhaust stroke from BDC(sec) toward TDC(sec). During Phase B, the primary piston 26' pushes a charge of hot exhaust gas into the secondary cylinder through open valve 92, displacing the used mixture of steam and exhaust gas from the secondary cylinder. The movement of the secondary piston to TDC(sec) may complete the expulsion of this mixture.

At the end of Phase B, the primary piston 26' may typically be approximately halfway from BDC(pri) toward TDC(pri). The secondary piston 28' reaches TDC(sec). The primary inlet valve 90 remains closed; the primary exhaust valve 92 is open; the secondary exhaust valve 94 closes.

Figure 7:
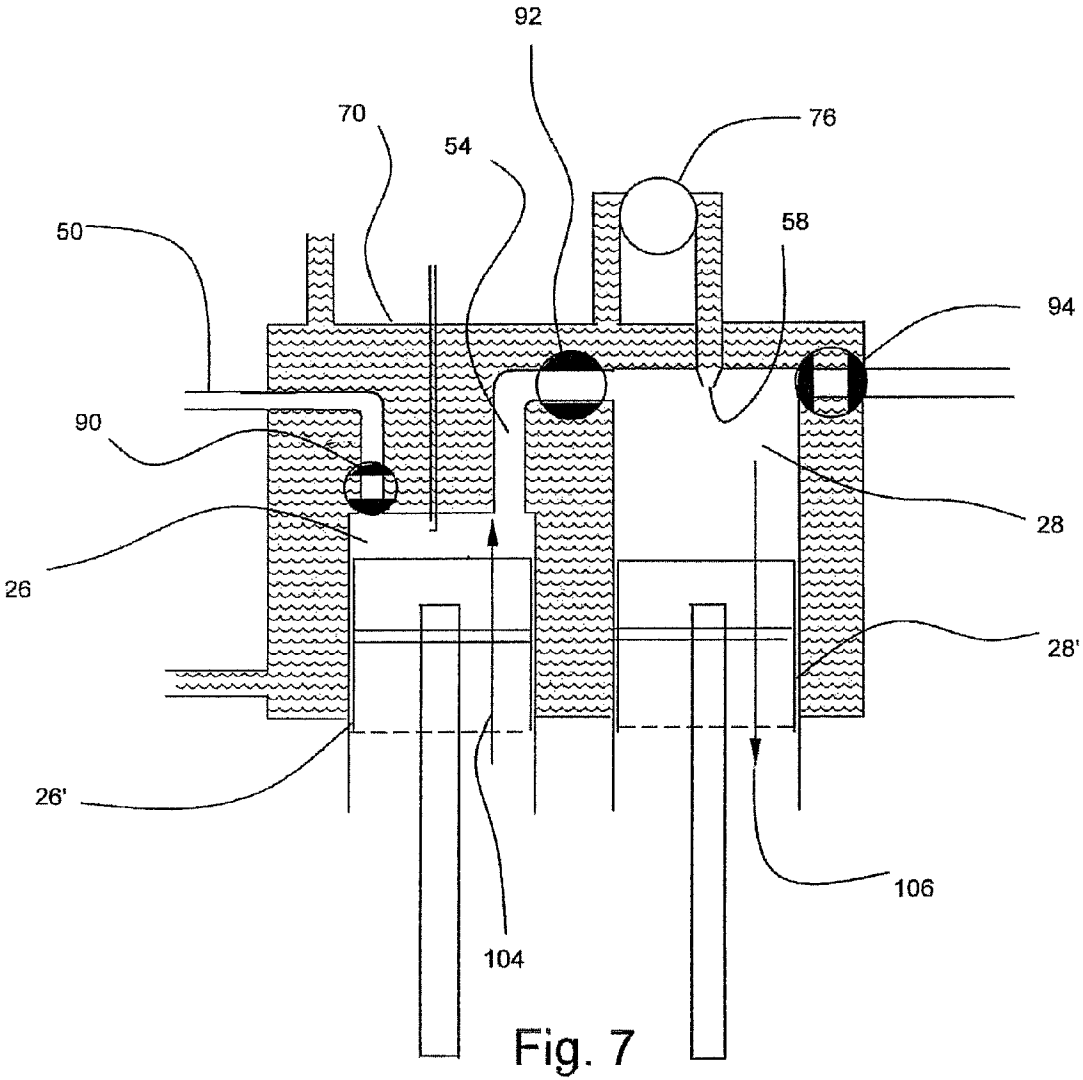

Phase C: FIG. 7

Phase C begins with the primary piston 26' in the middle of its exhaust stroke from BDC(pri) to TDC(pri) and the secondary piston 28' at TDC(sec). The primary inlet valve 90 remains closed; the primary exhaust valve 92 remains open; the secondary exhaust valve 94 is closed.

During Phase C, the primary piston completes its exhaust stroke, reaching TDC(pri) as indicated by arrow 104 in FIG. 7. The secondary piston begins its stroke toward BDC(sec) as indicated by arrow 106. The transfer of a charge of hot exhaust gas from the primary to the secondary cylinder may typically be completed during Phase C. The movement of the secondary piston away from TDC(sec), which may increase the space in the secondary cylinder, may prevent the development of back pressure in the primary cylinder outlet 54, and indeed may produce a negative pressure, drawing the remaining hot exhaust gases from the primary cylinder into the secondary cylinder.

At the end of Phase C, the primary piston 26' may reach TDC(pri); the secondary piston 28' may be approximately one quarter the way from TDC(sec) toward BDC(sec). The primary inlet valve 90 opens; the primary exhaust valve 92 closes; the secondary exhaust valve 94 remains closed.

Figure 8:
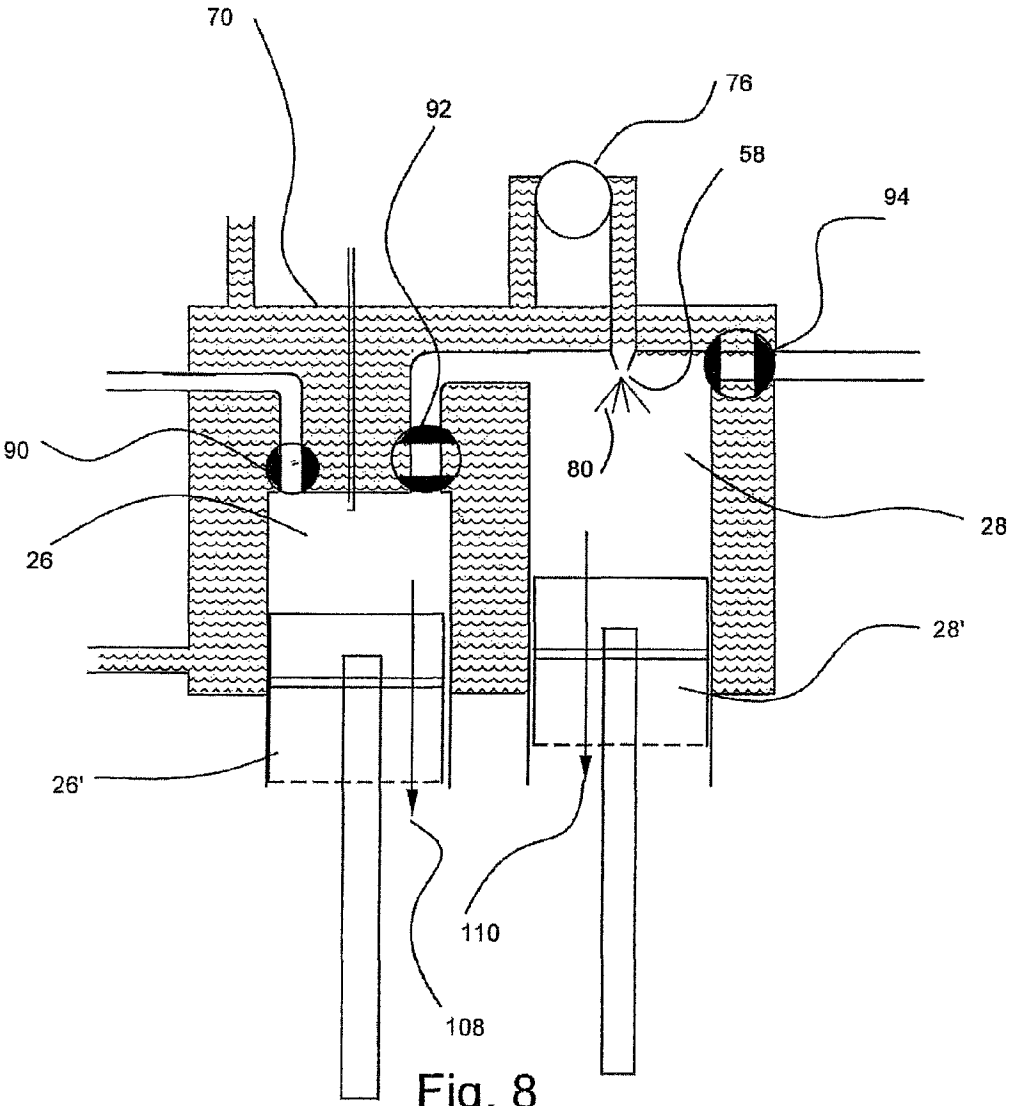

Phase D, FIG. 8

Phase D begins with the primary piston 26' at TDC(pri), having completed its exhaust stroke. The secondary piston 28' may typically be approximately one quarter the way from TDC(sec) toward BDC(sec). The primary inlet valve 90 opens; the primary and secondary exhaust valves 92 and 94, respectively, are both closed.

During Phase D, the primary piston may typically make its complete induction stroke from TDC(pri) to BDC(pri) in the direction indicated by arrow 108 in FIG. 8. The secondary piston 28' may typically continue its stroke from TDC(sec) to BDC(sec). At this time the secondary cylinder 28 may typically be filled with hot exhaust gas from the primary cylinder. A spray 80 of water may be injected into the secondary cylinder 28 by pump 76 via nozzle 58 for conversion to steam by the heat from the exhaust gas. The expansion of water turning to steam may typically cause an overpressure in the secondary cylinder, thereby providing a power stroke.

At the end of Phase D, the primary piston 26' may typically reach BDC(pri). The secondary piston 28' may typically continue to move toward BDC(sec) as indicated by arrow 110. The primary inlet valve 90 closes, both exhaust valves 92 and 94 remain closed.

Figure 9:
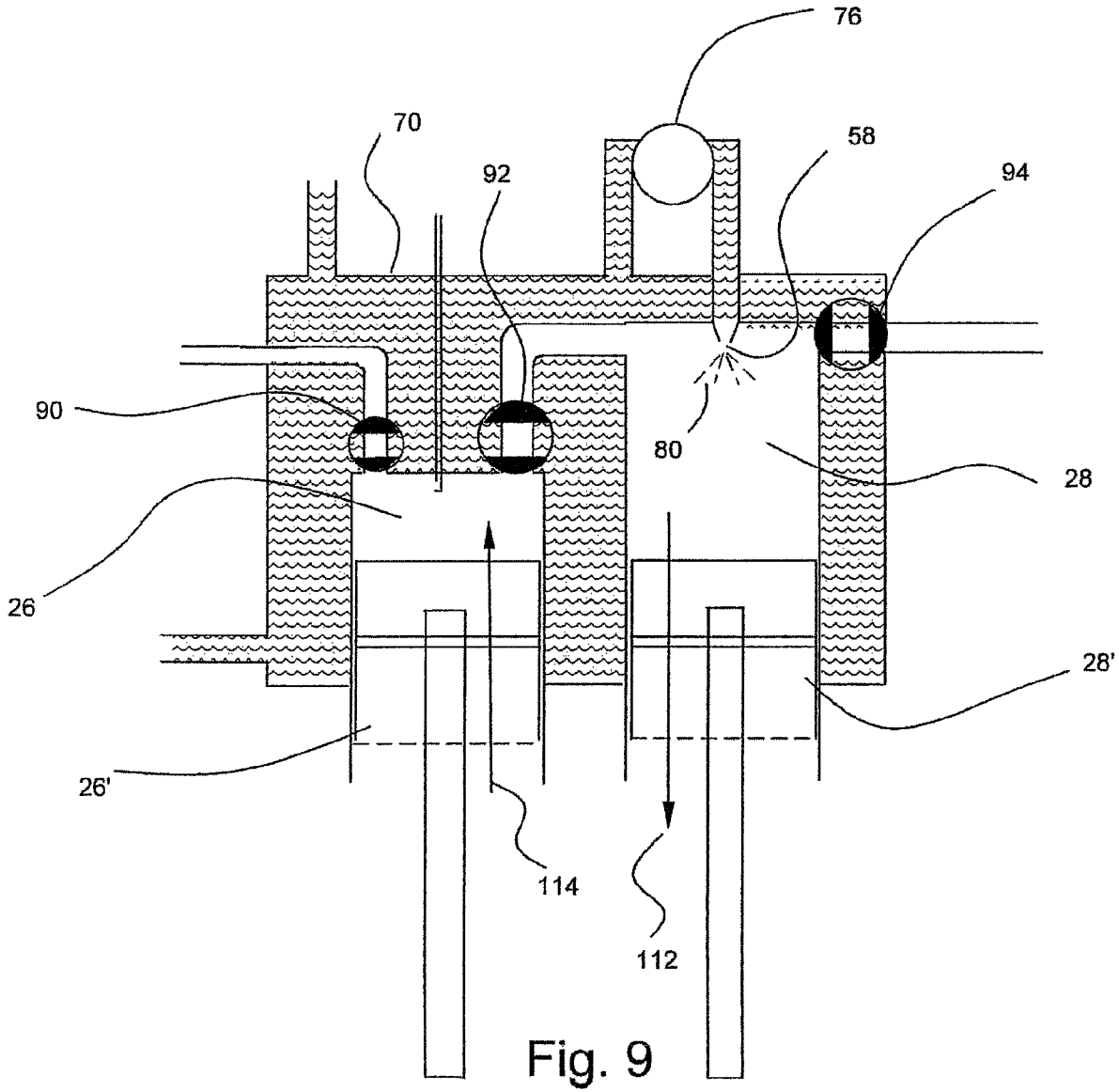

Phase E, FIG. 9

Phase E begins with the primary piston 26' at BDC(pri). The secondary piston 28' is moving toward BDC(sec) as indicated by arrow 112 in FIG. 9. The primary inlet valve 90 closes; both exhaust valves 92, 94 are closed.

During Phase E, the primary piston 26' begins its compression stroke in the direction indicated by arrow 114 in FIG. 9. The secondary piston 28' may typically continue to move toward BDC(sec) propelled by steam pressure in the secondary cylinder 28. Injection of a water spray 80 into the secondary cylinder 28 may typically coincide with all or part of Phase D and may continue into Phase E.

At the end of Phase E, the primary piston 26' may typically be moving toward TDC(prim); the secondary piston 28' may reach BDC(sec) at the completion of its power stroke. The inlet valve 90 and primary exhaust valve 92 remain closed. The secondary exhaust valve 94 opens.

Figure 10:
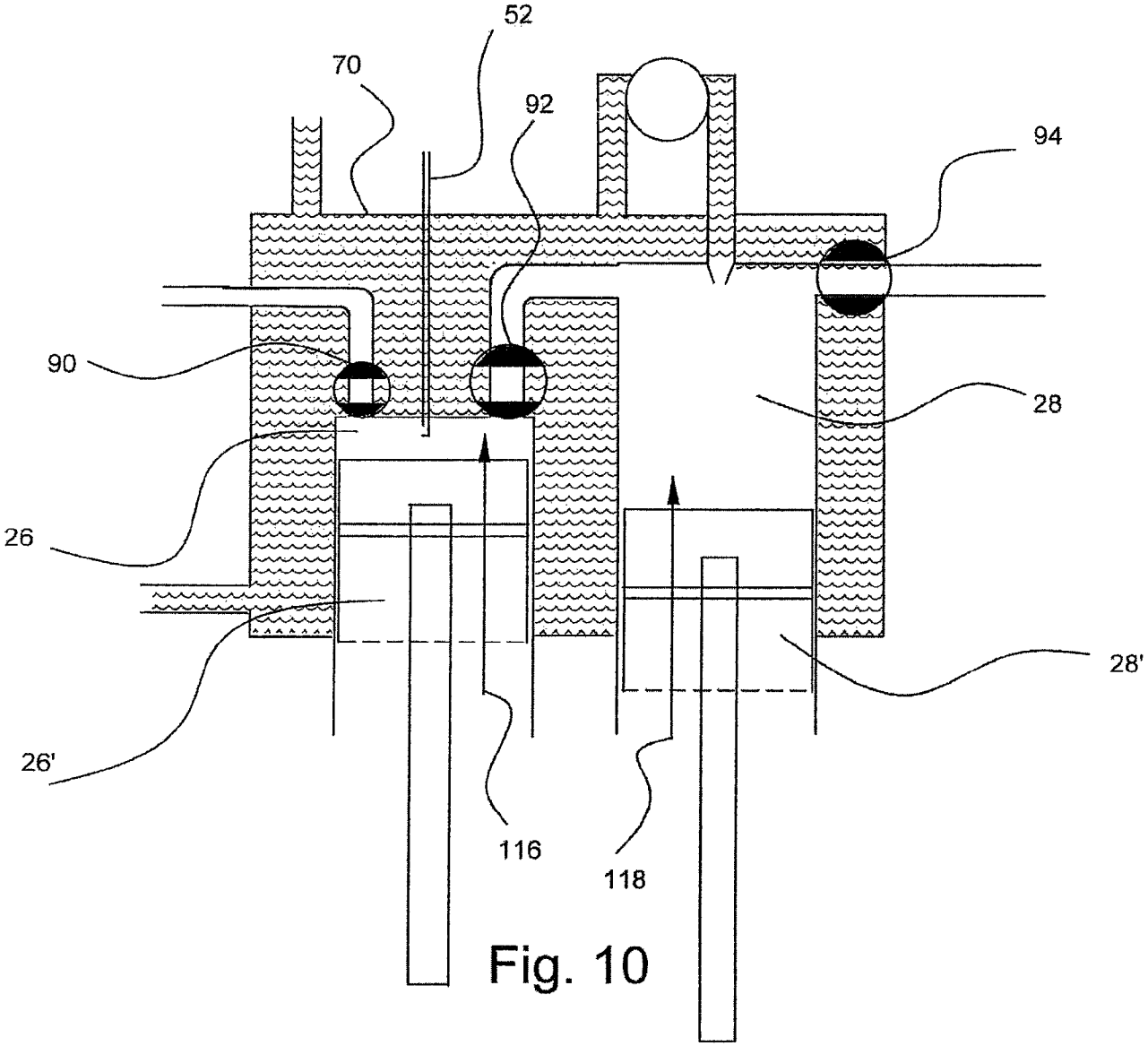

Phase F, FIG. 10

Phase F begins with the secondary piston 28' at BDC(pri). The primary piston 26' may typically be moving toward TDC (pri) as shown by arrow 116. The primary inlet valve 90 and the primary exhaust valve 92 both remain closed. The secondary exhaust valve 94 opens.

During Phase F, the primary piston may typically reach TDC(pri), completing its compression stroke. The secondary piston may typically begin its exhaust stroke, expelling the mixture of steam and exhaust gas through the secondary exhaust outlet 94.

At the end of Phase F, the primary piston 26' may typically reach TDC(pri) at the end of its compression stroke. The secondary piston 28' may typically be approximately one quarter of the way from BDC(sec) toward TDC(sec). The primary inlet valve 90 and primary exhaust valve 92 are both closed; the secondary exhaust valve 94 is open. The cycle then begins again with Phase A.

In another embodiment, the water spray 80 may be injected into the secondary cylinder 28 continuously. Steam may, therefore, be generated substantially continuously and may apply pressure to the secondary piston 28' whenever the primary and secondary exhaust valves 92, 94 are both closed, preventing the escape of the steam. This may typically be arranged to occur when the secondary piston is moving from TDC towards BDC; a pressure in excess of atmospheric pressure may thus tend to power the secondary piston, so adding power to the crankshaft. This modification would provide a simplified manner of injecting water into the second cylinder.

In another embodiment, the secondary cylinder 28 may be formed without additional headspace 62 as shown in FIG. 3. This change would allow common manufacturing processes for both the primary and the secondary cylinder heads. In this arrangement, only a slight modification to a conventional four-stroke engine may be required. Experiments may show that, even though the intake and power stroke in the secondary cylinder may tend to exert a back pressure opposing the exhaust stroke of the primary cylinder, there may still be a net gain in thermal efficiency, compared to a conventional internal combustion engine.

In illustrated embodiments of FIGS. 1 to 11 of the present hybrid engine, the engine configuration has generally been based on each primary cylinder being paired with a secondary cylinder. The present hybrid engine is not limited to such configurations, and the primary cylinder and secondary cylinder may be some same or different in volume, number and layout.

Additional hybrid engine configurations that incorporate multiplex and multistage arrangements of cylinders are shown schematically in FIGS. 11 to 14.

Figure 11:
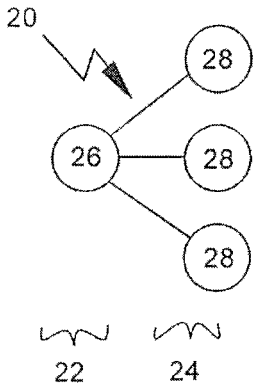
FIG. 11 is a schematic view of an embodiment of the present hybrid engine in which each primary cylinder of the primary internal combustion engine portion supplies exhaust gas to a plurality of secondary cylinders of the external combustion engine portion.

FIG. 11 is a schematic view of an alternative multiplex embodiment of the present hybrid engine 20 in which the primary internal combustion engine portion 22 includes at least one primary cylinder 26 in which each primary cylinder communicates with a plurality of secondary cylinders 28 of the secondary external combustion engine portion 24 to supply exhaust gas.

Figure 12:
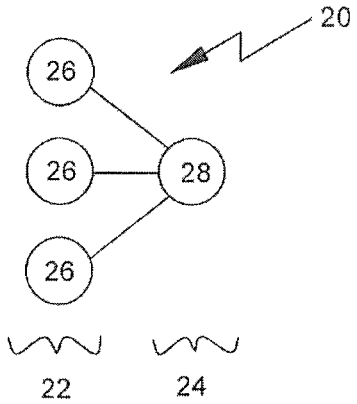
FIG. 12 is a schematic view of an embodiment of the present hybrid engine in which a plurality of primary cylinders of the primary internal combustion engine portion supply exhaust gas to a single secondary cylinder of the external combustion engine portion.

FIG. 12 is a schematic view of an alternative multiplex embodiment of the present hybrid engine 20 in which the secondary external combustion engine portion 24 includes at least one secondary cylinder 28 in which each secondary cylinder communicates with a plurality of primary cylinders 26 of the primary internal combustion engine portion 22 to receive exhaust gas.

Figure 13:
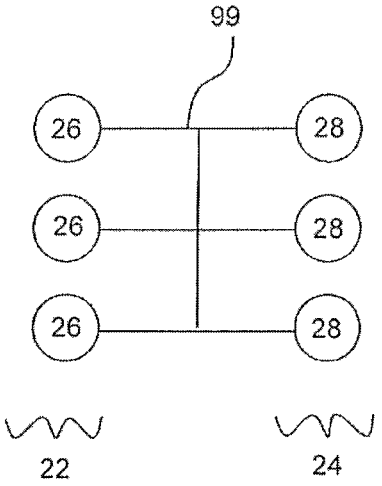
FIG. 13 is a schematic view of an embodiment of the present hybrid engine in which a plurality of primary cylinders of the primary internal combustion engine portion supply exhaust gas to a plurality of secondary cylinders of the external combustion engine portion via an exhaust manifold.

FIG. 13 is a schematic view of a still further multiplex arrangement of the present hybrid engine in which a plurality of primary cylinders 26 of the primary internal combustion engine portion 22 supply exhaust gas to a plurality of secondary cylinders 28 of the external combustion engine portion via an exhaust manifold 99.

Figure 14:
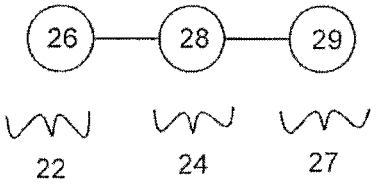
FIG. 14 is a schematic view of a further embodiment of the hybrid engine according to the present design in which the exhaust gases from the secondary cylinder of the secondary external combustion engine portion are delivered to a tertiary cylinder of a tertiary external combustion engine portion.

The present hybrid engine design does not preclude multiple stages of steam generation and expansion. For example, FIG. 14 is a schematic view of a multistage embodiment of the present hybrid engine which includes a tertiary external combustion engine portion 27 which receives the exhaust gases from the secondary external combustion engine portion 24 to generate steam in a tertiary cylinder 29 for a power stroke of a tertiary piston.

In all of the various embodiments of the present hybrid engine described above, the movement of the pistons will be sinusoidal based on a plot of piston velocity vs. time. It will be appreciated that the present hybrid engine design does not preclude an arrangement such that the movement of the primary and/or secondary pistons may not be sinusoidal.

In a further embodiment of the present hybrid engine, the primary internal combustion engine portion may function on a two-stroke cycle rather than a four stroke cycle. In this case, the heated exhaust gases of the primary cylinder would be generated during the power/exhaust stroke of the two stroke primary engine portion. As the top of the primary piston passes an exhaust port, the pressurized exhaust gases begin to exit to the secondary cylinder. As the primary piston continues moving toward bottom dead centre, the piston compresses an air/fuel/oil mixture in the crankcase so that once the top of the piston passes a transfer port, the compressed charge enters the primary cylinder from the crankcase and any remaining exhaust is forced out. The intake/compression stroke begins as the primary piston starts to move to top dead centre. This movement compresses the charge in the cylinder and draws a vacuum in the crankcase, pulling in more air, fuel, and oil.

In a still further embodiment, the primary internal combustion engine portion may function as a diesel engine.

Figure 15:
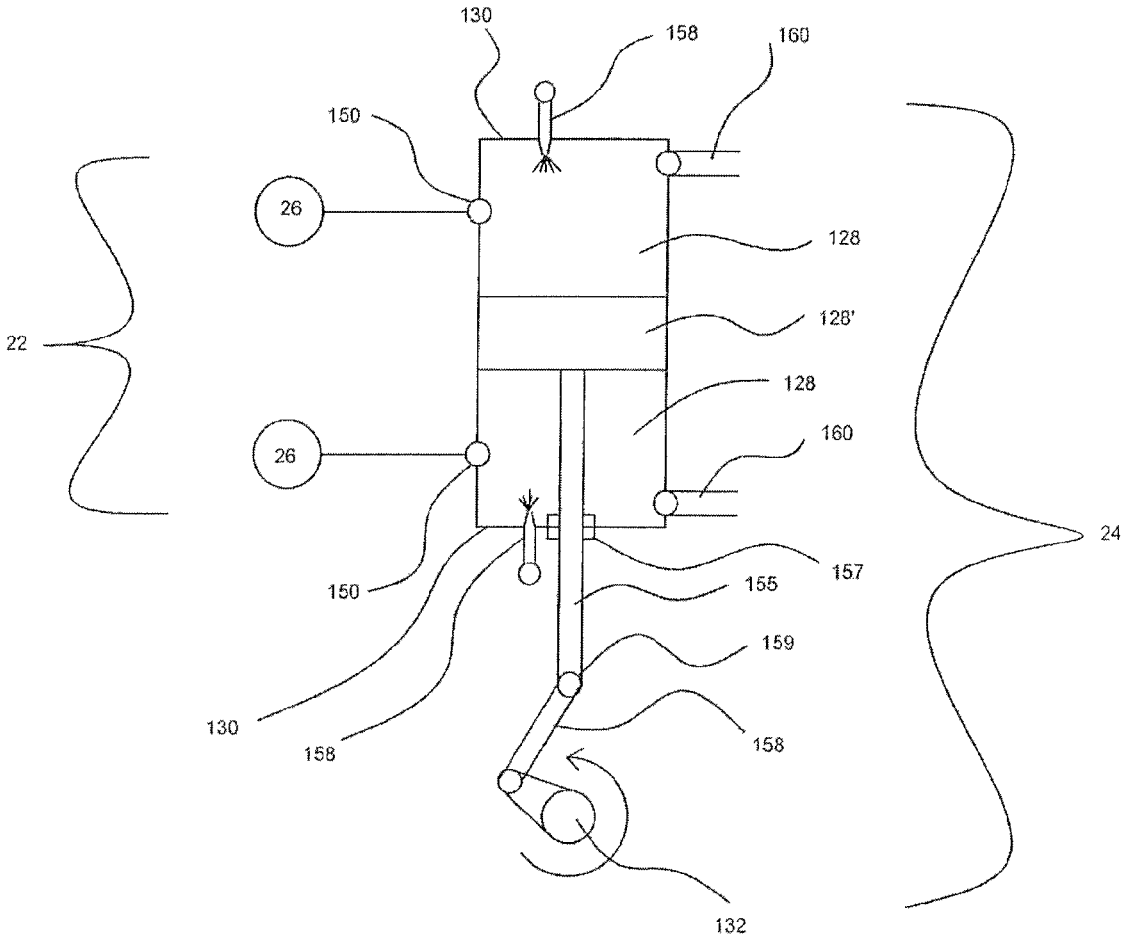
FIG. 15 is a schematic view of an alternative embodiment in which the secondary piston of the secondary external combustion engine is a double acting piston.

Referring to FIG. 15, there is shown a schematic view of another embodiment in which the secondary piston of the secondary external combustion engine 24 is a double acting piston 128'. In this arrangement, the secondary cylinder 128 houses a secondary piston 128' which is configured and positioned such that gas (steam) pressure may be applied to both sides of the secondary piston in alternation. In this embodiment, the secondary cylinder 128 has two closed ends 130 unlike the previously described embodiment in which one end of the cylinder is closed while the other end may be open. In this arrangement, the secondary cylinder 128 is equipped with an inlet 150, an outlet 160 and a fluid injector 158 at opposite ends of the cylinder. The secondary piston rod 155 in this embodiment may be rigidly attached to the secondary piston with the secondary piston rod passing through a seal or gland 157 in the end wall of the secondary cylinder. The secondary connecting rod 158 is pivotally connected at joint 159 to the end of the secondary piston rod externally to the secondary cylinder. The cycle phases A to F described above may typically take place in both ends of the secondary cylinder, phased so that the power stroke in the secondary cylinder is applied to opposite sides of the secondary piston in an alternating manner. One or more primary cylinders 26 may supply exhaust gases to one end of the secondary cylinder 128, while one or more other primary cylinders may supply exhaust gases to the other end of the secondary cylinder. The utility of this embodiment lies in the capacity of fewer secondary cylinders 128 to use the exhaust gases of more primary cylinders than may be practical in the previously described embodiments.

In another embodiment, the secondary pistons and cylinders of the secondary external combustion engine portion may be arranged on the uniflow system. In this design, the exhaust port of the secondary cylinder may be located in the wall of the secondary cylinder in such a position that the movement of the secondary piston to at or near BDC(sec) will uncover the exhaust port, thereby allowing a flow of gases out of the secondary cylinder without the action of the separate exhaust valve required by the first-described embodiment. The utility of this embodiment lies in the absence of a secondary exhaust valve and its timing mechanism.

Although the present invention has been described in some detail by way of example for purposes of clarity and understanding, it will be apparent that certain changes and modifications may be practised within the scope of the appended claims.

I claim:

1. A hybrid engine comprising:

a primary internal combustion engine portion having at least one primary cylinder housing a primary piston for reciprocating movement to drive a primary crankshaft;

a secondary external combustion engine portion having at least one secondary cylinder housing a secondary piston for reciprocating movement to drive a secondary crankshaft;

a gearing system interconnecting the primary and secondary crankshafts to allow the primary internal combustion engine portion and the secondary external combustion engine portion to operate at different cycling speeds;

an inlet to the at least one primary cylinder controlled by an inlet valve to deliver fuel to the at least one primary cylinder to generate a power stroke for the primary piston;

an outlet from the at least one primary cylinder controlled by a first outlet valve for discharge of exhaust gases from the at least one primary cylinder on an exhaust stroke of the primary piston, said outlet communicating with the at least one secondary cylinder;

an outlet from the at least one secondary cylinder controlled by a second outlet valve for exhaust gases to exit the at least one secondary cylinder;

a fluid reservoir to store heat generated in the at least one primary cylinder; and a fluid inlet for delivering fluid from the fluid reservoir to the at least one secondary cylinder for contact with the heated exhaust gases for vapourization into a volume of gas to generate a power stroke for the secondary piston wherein the power strokes of the primary and secondary pistons contribute to rotation of the primary crankshaft.

2. The hybrid engine of claim 1 in which the fluid reservoir comprises a fluid jacket adapted to cool at least the primary internal combustion engine portion.

3. The hybrid engine of claim 2 in which the fluid jacket extends about the secondary external combustion engine portion.

4. The hybrid engine of claim 1 in which the primary internal combustion engine portion operates as a four stroke engine.

5. The hybrid engine of claim 4 in which the primary internal combustion engine operates using spark-ignition.

6. The hybrid engine of claim 4 in which the primary internal combustion engine operates using compression ignition.

7. The hybrid engine of claim 1 in which the primary internal combustion engine portion operates as a two stroke engine.

8. The hybrid engine of claim 1 in which the secondary external combustion engine portion operates as a steam engine.

9. The hybrid engine of claim 7 in which the secondary external combustion engine operates as a reciprocating, open circuit steam engine.

10. The hybrid engine of claim 1 in which the primary internal combustion engine portion and the secondary external combustion engine portion operate such that the secondary crankshaft rotates slower than the primary crankshaft.

11. The hybrid engine of claim 1 in which the secondary piston of the secondary external combustion engine portion operates at half the cycling speed of the primary piston of the internal combustion engine portion.

12. The hybrid engine of claim 1 to in which the primary internal combustion engine portion and the secondary steam engine portion operate with a phase difference between the engine portions.

13. The hybrid engine of claim 12 in which the phase difference is 135 degrees between top dead centre in the primary piston of the primary internal combustion engine portion and top dead centre in the secondary piston of the secondary steam engine portion.

14. The hybrid engine of claim 1 in which the gearing system interconnecting the primary and secondary crankshafts comprises:

a primary gear rotatable with the primary crankshaft;

a secondary gear rotatable with the secondary crankshaft;

an idler gear train connecting the primary gear and the secondary gear to allow the secondary crankshaft to transmit torque to the primary crankshaft and the primary crankshaft to transmit torque to the secondary crankshaft.

15. The hybrid engine of claim 14 in which the idler gear train comprises:

a primary idler gear engaging the primary gear;

a secondary idler gear engaging the secondary gear; and an idler shaft connecting the primary idler gear with the secondary idler gear.

16. The hybrid engine of claim 14 in which the gears allow the crankshafts to rotate at different speeds, and the gears are sized to allow the secondary crankshaft to operate at a different rotary speed than the primary crankshaft.

17. The hybrid engine of claim 1 in which the primary crankshaft and the secondary crankshaft are aligned co-axially.

18. The hybrid engine of claim 1 in which the internal combustion engine portion and the external combustion engine portion are formed in a single engine block.

19. The hybrid engine of claim 1 in which each of the at least one primary cylinders communicates with a plurality of secondary cylinders.

20. The hybrid engine of claim 1 in which each of the at least one secondary cylinders communicates with a plurality of primary cylinders.

21. The hybrid engine of claim 1 in there are a plurality of primary cylinders which communicate with a plurality of secondary cylinders via an exhaust manifold.

22. The hybrid engine of claim 1 including a tertiary external combustion engine portion which receives the exhaust gases from the secondary external combustion engine portion.

23. The hybrid engine of claim 1 in which the secondary cylinder of the secondary external combustion engine houses a double acting piston adapted to have heated exhaust gases and fluid from the fluid reservoir delivered to both sides of the double acting piston in alternation.

24. The hybrid engine of claim 1 in which the fluid inlet for delivering fluid to the at least one secondary cylinder comprises:

a pump to deliver the fluid under pressure; and a nozzle to inject the fluid under pressure into the secondary cylinder as a spray of atomized droplets.

25. The hybrid engine of claim 1 in which the fluid in the fluid reservoir is maintained at an elevated temperature below the boiling point of the fluid.

26. The hybrid engine of claim 1 in which the fluid in the fluid reservoir is replenished from a fluid supply.

27. The hybrid engine of claim 1 in which the fluid reservoir includes a heat exchanger for controlling the temperature of the fluid.

28. The hybrid engine of claim 1 in which the at least one secondary cylinder is formed with an enlarged volume compared with the at least one primary cylinder.

29. The hybrid engine of claim 28 in which the enlarged volume of the at least one secondary cylinder includes an additional headspace such that the volume of each secondary cylinder when the secondary piston is at top dead center (TDC) is substantially equal to a volume swept by each primary piston in the primary cylinder.

30. A hybrid engine comprising:

a primary internal combustion engine portion to drive a primary crankshaft;

a secondary external combustion engine portion to drive a secondary crankshaft;

a gearing system interconnecting the primary and secondary crankshafts to allow the primary internal combustion engine portion and the secondary external combustion engine portion to operate at different cycling speeds;

an inlet to deliver fuel to the primary internal combustion engine portion to generate power for driving the primary crankshaft;

an outlet from the primary internal combustion engine to discharge heated exhaust gases, said outlet communicating with the secondary external combustion engine portion;

an outlet from the secondary external combustion engine portion for exhaust gases to exit;

a heat reservoir to store heat generated by the primary internal combustion engine portion; and a fluid reservoir for delivering fluid to the secondary external combustion engine portion for contact with the exhaust gases for vapourization into a volume of gas to generate power for driving the secondary crankshaft wherein rotation of the secondary crankshaft contributes to rotation of the primary crankshaft.

31. The hybrid engine of claim 30 in which the heat reservoir and the fluid reservoir are the same reservoir.

32. The hybrid engine of claim 30 in which the secondary external combustion engine portion operates as a steam engine.

* * * * *